US006716486B2

(12) United States Patent
Kormos

(10) Patent No.: US 6,716,486 B2
(45) Date of Patent: Apr. 6, 2004

(54) APPARATUS AND METHOD FOR APPLYING MUD TO DRYWALL TAPE

(76) Inventor: Dave Kormos, 44 Fallingworth Bay N.E., Calgary, Alberta (CA), T3J 1J3

( * ) Notice: Subject to any disclaimer, the term of this patent is extended or adjusted under 35 U.S.C. 154(b) by 0 days.

(21) Appl. No.: 09/883,461

(22) Filed: Jun. 15, 2001

(65) Prior Publication Data

US 2002/0020345 A1 Feb. 21, 2002

(51) Int. Cl.[7] ..... B05D 1/18

(52) U.S. Cl. ..... 427/434.7; 427/430.1; 427/434.2

(58) Field of Search ..... 427/430.1, 434.2, 427/434.7; 118/405, 423, 429

(56) References Cited

U.S. PATENT DOCUMENTS 4,757,783 A * 7/1988 Matheny ..... 118/413
5,242,495 A 9/1993 Hammond et al.
5,498,287 A 3/1996 Barnfield
5,676,793 A 10/1997 Martin et al.

* cited by examiner

*Primary Examiner*—Michael Barr
(74) *Attorney, Agent, or Firm*—Adams Evans P.A.

(57) ABSTRACT

A method for applying drywall mud to drywall tape includes threading the drywall tape through mud in a container. When the drywall process is interrupted, a strip of material longer than the distance across the container is attached to the drywall tape between the roll and the container. The strip of material has a tensile strength substantially unaffected by prolonged exposure to drywall mud. The drywall tape with attached material is drawn through the container until both ends of the strip of material extend outside the container on opposite sides thereof. The container is sealed and may now be left for a prolonged period of time. To re-commence the drywall process, the tape and applied material is drawn through the slots until the material exits the container and is torn off and discarded, leaving a free end of drywall tape outside the container. The material is conveniently adhesive tape.

12 Claims, 4 Drawing Sheets

APPARATUS AND METHOD FOR APPLYING MUD TO DRYWALL TAPE

This invention is in the field of construction methods and in particular methods for applying drywall mud to drywall tape.

BACKGROUND

Drywall finishing requires that joints and corners be finished by applying drywall mud thereto, allowing the mud to dry, and sanding smooth. Several coats may be required to provide a smooth finish that is satisfactory. The initial coat on a joint comprises a paper or mesh strip, commonly called drywall tape, which is coated with mud and then applied over the joint. Where the job is done by hand, a coat of mud is generally applied to the joint, the tape is pressed into this mud, and another layer of mud is applied over the tape.

Also known are apparatuses for applying mud to drywall tape by drawing the tape through slots on one side or each side of a pail of mud. Such apparatuses are disclosed in U.S. Pat. No. 5,676,793 to Martin et al.; U.S. Pat. No. 5,242,495 to Hammond et al.; and U.S. Pat. No. 5,498,287 to Barnfield. These demonstrate a relatively simple and effective means of coating drywall tape with mud.

If left standing in these prior art containers, paper drywall tape becomes saturated and deteriorates to the point where same can no longer withstand the force required to pull it through the container of mud. Should the drywall procedure be interrupted for a period of time, the tape may break when next the operator pulls on the free end of the tape extending from the bucket. The operator of the Barnfield or Hammond devices must then remove the mud from the container and re-thread fresh tape through the slots in the container. The Martin device does provide a feeder plate and guide for installation in the container for pulling the tape through the mud and container slots.

SUMMARY OF THE INVENTION

It is an object of the present invention to provide a simple, economical method and apparatus that allows for use of a slotted container of mud with drywall tape drawn through the slots and the mud, on an intermittent basis, such that the open container top could be sealed, and the drywall tape left threaded through the slots, for extended periods, such as from one day to the next, or longer.

It is a further object of the invention to provide an apparatus for conveniently applying drywall mud to drywall tape.

The invention accomplishes the object in one aspect by providing a container with access through slots in opposing sidewalls to thread a free end of a roll of drywall tape. A free end of a roll of drywall tape is threaded from an outside of the container through a first slot, then through the container, then through a second slot to the outside of the container. Drywall mud is placed into the container to a level above the drywall tape and the drywall tape is drawn through the slots, thereby coating same with drywall mud. Coated drywall tape is torn off while leaving a free end of drywall tape outside the container available for grasping and pulling more drywall tape.

When the drywall process is interrupted, a strip of material, such as adhesive tape, is attached to at least one surface of the drywall tape between the roll and the first slot. The strip of adhesive tape is substantially longer than the distance across the container and has a tensile strength substantially unaffected by prolonged exposure to drywall mud.

The drywall tape with attached adhesive tape is drawn through the first and second slots until a first end of the strip of adhesive tape extends outside the container and a second end of the adhesive tape remains between the roll and the first slot. The open top of the container is sealed and the apparatus, with tape still threaded through the container may now be left for a prolonged period of time. While the drywall tape in the container will deteriorate, the adhesive tape will not.

When it is desired to re-commence the drywall process, the drywall tape and applied adhesive tape is drawn through the slots until the second end of the strip of adhesive tape exits the container through the second slot. The strip of adhesive tape and attached drywall tape is torn off and discarded, leaving a free end of drywall tape outside the container available for grasping and pulling more drywall tape.

Some drying and solidification of the mud adjacent to the slots can occur. This can result in undesirable granules of dried mud on the coated drywall tape when the process is restarted. The slots may be plugged or taped over to prevent drying of the mud. Alternatively The method is suitable for small jobs, since mud coated drywall tape is always quickly available, and an apparatus can be stored for relatively lengthy periods.

In a second aspect the invention provides an apparatus for applying drywall mud to drywall tape, comprising a base, having a flat bottom surface, a roll end and a dispensing end, a container including an open top, sidewalls and a floor, and attached to an upper surface of the base, between the roll end and dispensing end. A first slot is defined by one sidewall facing the roll end, and a second slot is defined by an opposite sidewall facing the dispensing end of the base. The slots are located in proximity to the container floor. A cover is operative to releasably seal the open top of the container. A roll feeding member extends upwards from the roll end of the base. Means are provided to releasably and rotatably mount a roll of drywall tape on the roll feeding member, about a substantially horizontal axis, such that a lower extremity of the roll of drywall tape is above the bottom surface of the base.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
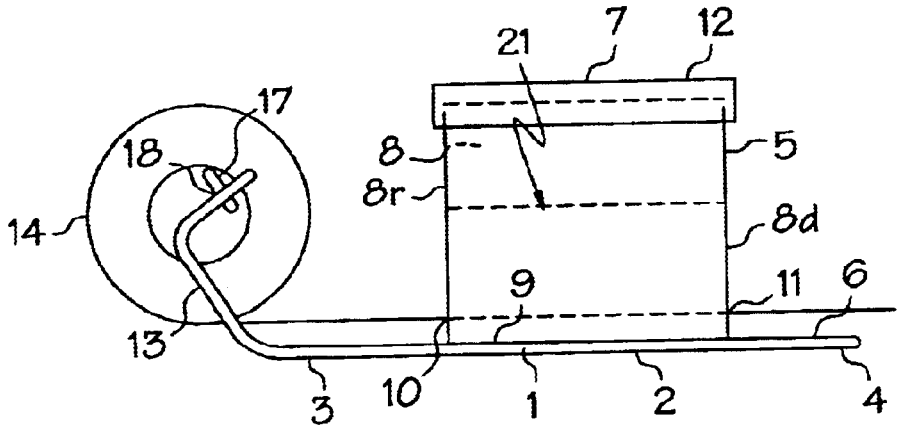
FIG. 1 is a side view of an apparatus for applying mud to drywall tape.
Figure 2:
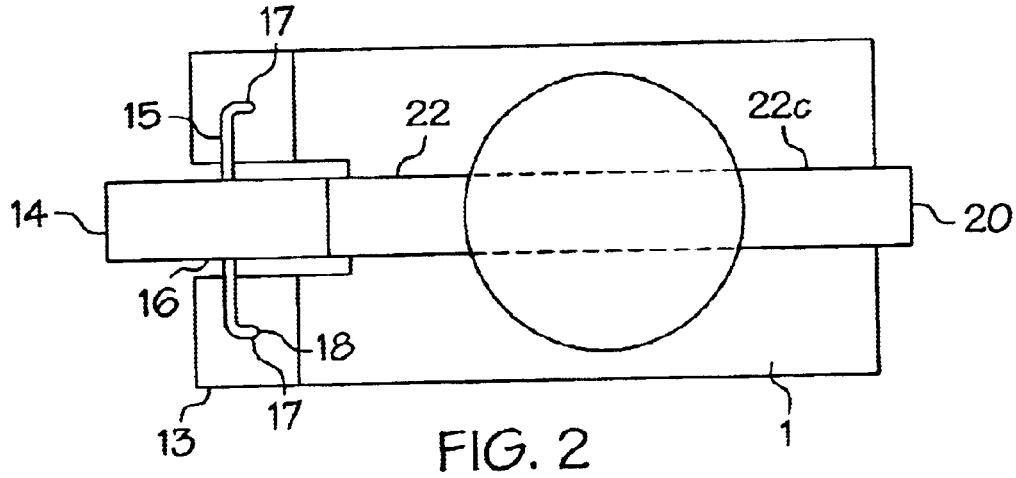
FIG. 2 is a top view of the apparatus of FIG. 1.

FIGS. 1 and 2 illustrate an apparatus for applying drywall mud to drywall tape.

The apparatus comprises a base 1, having a flat bottom surface 2 for resting on a table or floor, a roll end 3 and a dispensing end 4. A container 5 is attached to the upper surface 6 of the base 1, between the roll end 3 and the dispensing end 4. The container 5 includes an open top 7, sidewalls 8 and a floor 9. A first slot 10 is defined by one sidewall 8*r* facing the roll end 3 of the base 1, and a second slot 11 is defined by an opposite sidewall 8*d* facing the dispensing end 4 of the base 1. The slots 10, 11 are located in proximity to the floor 9 of the container 5. A cover 12 is operative to releasably seal the open top 7 of the container 5.

A roll feeding member 13 extends upwards from the roll end 3 of the base 1. In the illustrated embodiment, the roll feeding member 13 and base 2 are integral, with the roll feeding member 13 being a bent upwards extension of the base 2. A roll of drywall tape 14 is releasably and rotatably mounted on the roll feeding member 13, about a substantially horizontal axis such that a lower extremity 14*a* of the roll of drywall tape 14 is above the bottom surface 2 of the base 1. The roll 14 may then rotate freely.

The slots 10, 11 defined by the sidewalls 8 are substantially horizontal in the illustrated embodiment. This orientation accommodates feeding from the roll of drywall tape 14, however the slots 10, 11 could be oriented vertically or somewhere in between.

A gap 16 is defined by the roll feeding member 13 to accommodate the roll of drywall tape 14. The means to releasably and rotatably mount the roll of drywall tape 14 comprises a horizontal rod 15 extending across the top of the gap 16. A shaft 17 is attached at each end of the rod 15 substantially perpendicular to the horizontal rod 15 and parallel to each other. In the illustrated embodiment the shafts 17 and rod 15 are integral, the shafts 17 being simply bent from the rod 15. The illustrated shafts 17 are substantially parrallel and are slidingly received in apertures 18 defined by the roll feeding member 13 on each side of the gap 16. The rod 15 may thus be readily removed from the apparatus for removing or replacing the roll of drywall tape 14.

The illustrated apparatus can be used to practice the method of the invention for applying drywall mud to drywall tape allowing for lengthy stoppages in a drywall application process.

A free end 20 of a roll of drywall tape 14 is threaded from outside the container 5, through the first slot 10, then through the container 5, then through the second slot 11 to the outside of the container 5. Drywall mud 21 is placed into the container 5 to a level above the drywall tape 22. The drywall tape 22 is drawn through the slots 10, 11 thereby coating same with drywall mud 21. The coated drywall tape 22*c* is torn off as needed while always leaving a free end 20 of drywall tape 22 outside the container 5 available for grasping and pulling more drywall tape 22.

When the drywall process is interrupted, such as when the work day is finished, none of the prior art allows the drywall tape 22 to be left in mud 21, as the paper drywall tape will very quickly deteriorate by absorbing moisture from the mud 21 such that when it is attempted to grasp the free end 20 of the drywall tape 22 and pull more through the container 5, the drywall tape 22 will break. The operator must then remove mud 21 from the container 5 and re-thread drywall tape 22 through the container 5.

To avoid this there is attached to the drywall tape 22, between the roll 14 and the first slot 10, a strip of material having a tensile strength substantially unaffected by prolonged exposure to drywall mud 21. The strip of material is substantially longer than the distance across the container 5 between the first and second slots 10, 11. The strip may be attached to the drywall tape 22 by adhesives, staples or similar means.

Figure 3:
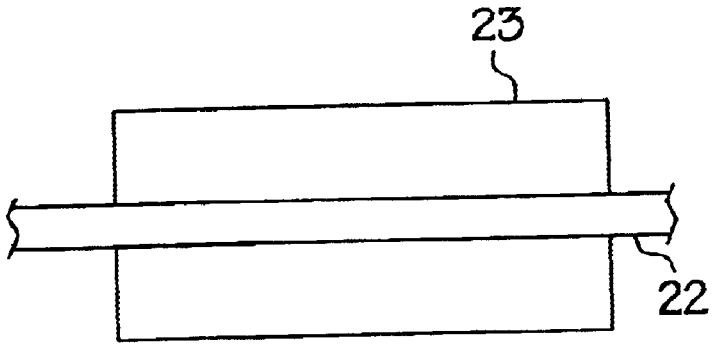
FIG. 3 is a top view showing a piece of plastic film in place to wrap around a section of drywall tape.
Figure 3A:
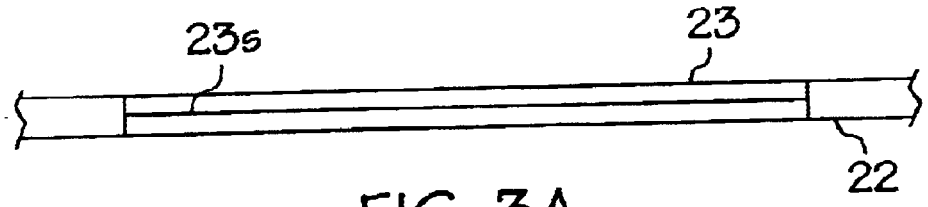
FIG. 3A is a side view showing the piece of plastic film of FIG. 3 wrapped around the section of drywall tape.

The strip of material may be plastic film 23 such as is illustrated in FIG. 3 and FIG. 3A, whose tensile strength is unaffected by exposure to mud 21 and is also impervious to moisture from mud 21. The plastic film 23 is attached to the drywall tape 22 by simply wrapping same around the drywall tape 22 so as to surround a portion of drywall tape 22 and prevent moisture from the mud 21 contacting the portion at drywall tape 22. The seam 23*s* may be sealed with glue or tape. This method prevents deterioration of the drywall tape 22 and allows same to remain in the mud 21 for prolonged periods and pulled through the container 5 at a later time.

Figure 4:
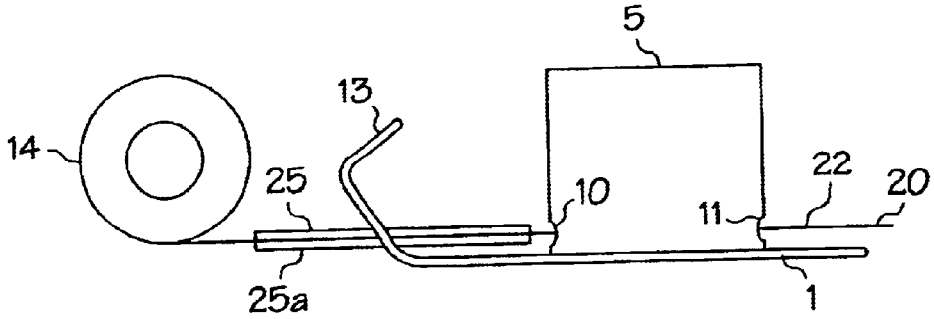
FIGS. 4–4B are side views of the apparatus of FIG. 1 showing the operation thereof.
Figure 4A:
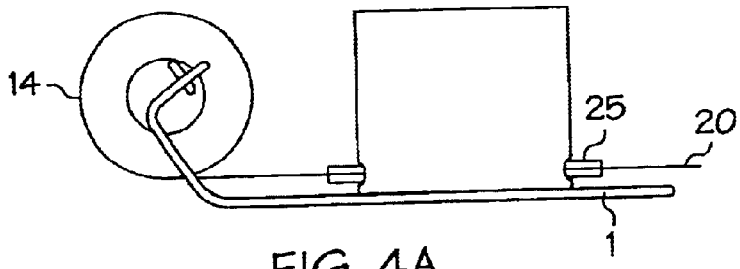
Figure 4B:
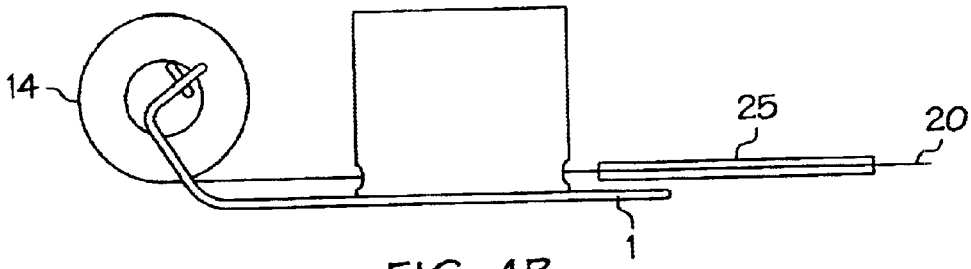

Alternatively, as illustrated in FIGS. 4, 4A and 4B, a strip of plastic adhesive tape 25 that is longer than the distance between the first and second slots 10, 11, is adhesively attached to one side of the drywall tape 22 between the roll 14 and the first slot 10. The attachment must be strong enough that the adhesive tape 25 will bring the drywall tape 22 with it when drawn through the slots 10, 11.

The drywall tape 22 with attached strip of material, such as either the plastic film 23 or adhesive tape 25, is drawn through the first and second slots 10, 11 until a first end 30 of the strip of material 23, 25 extends outside the container 5 and a second end 31 of the strip of material 23, 25 remains between the roll 14 and the first slot 10. The container 5 is sealed by installing the cover 12 on the open top 7 of the container 5. The slots 10, 11 may also be sealed with tape or plugs to prevent solidification of the mud 21 adjacent thereto and subsequent troublesome granules of dried mud adhering to the drywall tape 22.

Figure 6:
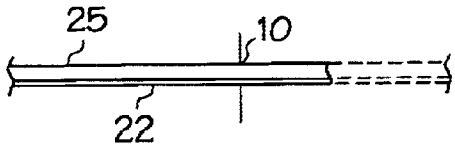
FIG. 6 is a side view of a slot in a container and a strip of drywall tape and attached plastic adhesive strip.
Figure 7:
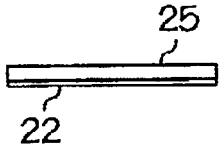
FIG. 7 is an end view of the slot, a strip of drywall tape and attached plastic adhesive strip of FIG. 6.

Alternatively, as illustrated in FIGS. 6 and 7, the slots 10, 11 may be sealed by providing a strip of material, such as plastic adhesive strip 26, that has a width substantially equal to the width of the drywall tape 22 and a thickness such that the drywall tape 22 and attached plastic adhesive strip 26 substantially fill the first and second slots 10, 11 when same are drawn therethrough, thereby substantially sealing the slots 10, 11. Typically, for the common two inch wide drywall tape 22, the slots 10, 11 will be 2.125 inches wide and about 0.06 inches deep.

The apparatus may then be left standing as illustrated in FIG. 4A for a prolonged period of time. When it is desired again to coat more drywall tape 22 with mud 21, the drywall tape 22 and applied strip of material 23, 25 are drawn through the slots 10, 11 until the second end 31 of the strip of material 23, 25 exits the container 5 through the second slot 11 as ill FIG. 4B. The strip of material 23, 25 and attached portion of drywall tape 22, may then be torn off and discarded, leaving a free end 20 of drywall tape 22 outside the container 5 available for grasping and pulling more drywall tape 5 through the container 5.

Figure 5:
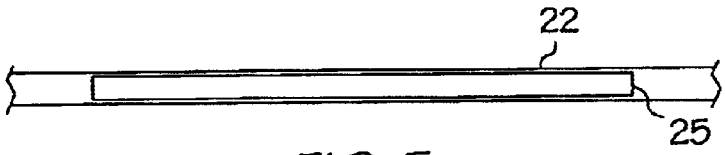
FIG. 5 is a top view of a piece of adhesive tape applied to a length of drywall tape.

In FIGS. 4, 4A and 4B, a second strip of adhesive tape 25*a* is adhesively attached to the drywall tape 22 on a side thereof opposite the strip of adhesive tape 25, however in most situations a strip of adhesive tape 25 on one side of the drywall tape 22 should suffice, provided the portion extending between the roll 14 and first slot 10 is adhered strongly enough to pull the drywall tape through the container 5. As illustrated in FIG. 5, for maximum strength of adhesion, the adhesive tape 25 has a width substantially equal to a width of the drywall tape 22.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A method for applying drywall mud to drywall tape allowing for lengthy stoppages in a drywall application process, said method comprising: threading a free end of a roll of drywall tape from an outside of a container through a first slot, then through said container, then through a second slot to the outside of said container; placing drywall mud into said container to a level above the drywall tape; drawing said drywall tape through said slots, thereby coating same with drywall mud, tearing off coated drywall tape while leaving a free end or drywall tape outside said container available for grasping and pulling more drywall tape; attaching to said drywall tape, between said roll and said first slot, a strip of material having a tensile strength substantially unaffected by prolonged exposure to drywall mud, said strip of material being substantially longer than the distance between said first and second slots, drawing said drywall tape with attached strip of material through said first and second slots until a first end of said strip of material extends outside said container and a second end of said strip of material remains between said roll and said first slot; sealing said container; drawing said drywall tape and applied strip of material through said slots until said second end of said strip of material exits said container through said second slot; tearing off and discarding said strip of material and attached drywall tape, leaving a free end of drywall tape outside said container available for grasping and pulling more coated drywall tape.

2. The method of claim 1 wherein said strip of material is adhesive tape and wherein same is adhesively attached to said drywall tape.

3. The method of claim 1 wherein said strip of material has a width substantially equal to a width of said drywall tape and a thickness such that said drywall tape and attached strip of material substantially fill said first and second slots when same are drawn therethrough, thereby substantially sealing said first and second slots.

4. The method of claim 1 wherein said strip of material is impervious to moisture from mud and wherein same is attached to said drywall tape so as to surround a portion of drywall tape and prevent moisture from said mud contacting said portion of drywall tape.

5. The method of claim 2 further comprising adhesively attaching a second strip of adhesive tape to said drywall tape on a side thereof opposite a first strip of adhesive tape.

6. The method of claim 2 wherein said adhesive tape has a width substantially equal to a width of said drywall tape.

7. The method of claim 1 further comprising rotatably mounting said roll of drywall tape adjacent to said container.

8. The method of claim 1 wherein said container includes an open top and wherein sealing said container is accomplished by sealing said open top.

9. The method of claims 8 wherein sealing said container further includes sealing said slots.

10. The method of claim 9 wherein said slots are sealed by adhesive tape.

11. The method of claim 1 wherein said container comprises sidewalls and a floor, and wherein said slots are substantially horizontal and located on opposing sidewalls in proximity to said floor.

12. A method for applying drywall mud to drywall tape allowing for lengthy stoppages in a drywall application process, said method comprising: threading a free end of a length of drywall tape, from a roll of drywall tape, from outside a container through a first slot, then through said container, then through a second slot to the outside of said container; placing drywall mud into said container to a level above the drywall tape; drawing said drywall tape through said container and slots, thereby coating same with drywall mud, tearing off coated drywall tape while leaving a free end of drywall tape outside said container available for grasping and pulling more drywall tape, adhesively attaching a first strip of adhesive tape to one side of said drywall tape between said roll and said first slot, said first strip of adhesive tape being substantially longer than the distance between said first and second slots, said adhesive tape having a tensile strength substantially unaffected by prolonged exposure to drywall mud; drawing said drywall tape with attached adhesive tape through said first and second slots until a first end of said first strip of adhesive tape extends outside said container and a second end of said first strip of adhesive tape remains between said roll and said first slot; sealing said container, drawing said drywall tape and applied adhesive tape through said slots until said second end of said first strip of adhesive tape exits said container through said second slot; tearing off and discarding said first strip of adhesive tape and attached drywall tape, leaving a free end of drywall tape outside said container available for grasping and pulling more drywall tape.

* * * * *